United States Patent [19]

Woods et al.

[11] Patent Number: 4,817,353

[45] Date of Patent: Apr. 4, 1989

[54] SELFCONTAINED INTEGRAL FOOTING FORM AND FOUNDATION WALL

[76] Inventors: John T. Woods; John D. Woods; Paul F. Woods; Frederick T. Woods, all of P.O. Box 1949, Decatur, Ga. 30031

[21] Appl. No.: 113,607

[22] Filed: Oct. 28, 1987

[51] Int. Cl.[4] ..... E02D 27/00

[52] U.S. Cl. ..... 52/295; 52/426; 52/742

[58] Field of Search ..... 52/742, 293, 294, 295, 52/426

[56] References Cited

U.S. PATENT DOCUMENTS

| | | | |
|---|---|---|---|
| 3,216,163 | 11/1965 | Carew | 52/295 |
| 3,751,867 | 8/1973 | Layne | 52/426 |
| 3,881,291 | 5/1975 | Layne | 52/426 |
| 4,226,061 | 10/1980 | Day | 52/426 |
| 4,348,847 | 9/1982 | Jakes | 52/426 |
| 4,457,118 | 7/1984 | Bowen | 52/742 |
| 4,464,873 | 8/1984 | Geiger | 52/193 |
| 4,512,120 | 4/1987 | Lindal | 52/192 |

FOREIGN PATENT DOCUMENTS

| | | | |
|---|---|---|---|
| 1495935 | 2/1967 | France | 52/293 |
| 2330818 | 5/1975 | France | 52/294 |
| 55-68931 | 5/1980 | Japan | 52/295 |
| 56-20238 | 2/1981 | Japan | 52/294 |
| 420097 | 11/1934 | United Kingdom | 52/293 |

*Primary Examiner*—Henry E. Raduazo

[57] ABSTRACT

A footing form which is attached to the stem wall, which may be either field or factory fabricated. All components of which are approved by the American Wood Preservers Bureau to standard "FDN" for direct earth contact. The footing form is filled with concrete and when said concrete hardens the form shirt is left in place, even though it adds no strength or serves any other useful purpose after the concrete hardens. Due to the treatment of the wood the form does not have to be removed from the ground, as is the case with all other untreated cellulose materials.

4 Claims, 1 Drawing Sheet

SELFCONTAINED INTEGRAL FOOTING FORM AND FOUNDATION WALL

BACKGROUND OF THE INVENTION

1. Field of the Invention

This invention relates to a prefabricated footing form in which a code approved selflevelling and self curing foundation substance, such as concrete may be poured or applied thereby forming the footing for a building. Part of the form is the foundation or stem wall which extends above the ground from the footing to the building and forms continuous bearing for the building. The novel part of this invention is that all parts remain in place as an integral part of the finished building.

2. Description of the Prior Art

Two basic types of footings are utilized at present to support buildings and structures, exclusive of piles and the like. They are poured concrete footings and footings which utilize a bed of crushed rock as the bearings media. Prior art teaches that to pour a concrete footing, (1) a ditch is dug and then filled with liquid concrete to a desired depth, or (2) rigid forms are placed in the ditch and liquid concrete is poured into the forms. After the concrete has hardened, in instance (2) the forms are removed. In either instance in filling the ditch much concrete is wasted as it is extremely difficult to precisely control the depth, width and height of the liquid foundation media. Therefore, rigid forms of wood, steel, aluminum or any number of other materials have been utilized to more precisely control and contain the liquid concrete. Job built forms are not patented, but some other systems of forms have been patented throughout the years. All of these above mentioned forms have one thing in common: they all must be removed after the concrete is set. Thus all prior art using concrete differs substantially from the claims of the instant invention. Prior art also teaches us that all-weather wood footings are designed to bear upon a bed of coarse graded gravel without the utilization of any concrete whatsoever in the bearing system. Again, prior art differs substantially from the instant invention.

SUMMARY OF THE INVENTION

Many attempts have been made to economically control the amount of concrete, crushed rock or approved foundation media used in a footing and yet produce a footing which will comply with a multiplicity of building codes, site requirements and building configurations as to size, shape and elevation. It is, therefore, a primary objective of the invention to allow a system of form members, which will not react or decompose i.e. are inert with contact to the earth and resistant to termites and other pests and fungi, to be utilized as both a containing form for the footing media, a foundation wall from the footing to the building, all of which shall not be removed and shall become a part of the finished building. Should treated lumber or plywood be utilized as form member material, it shall be treated to American Wood Preservers Bureau Standard "FDN" with 0.60 pounds per cubic foot retention, after drying to 19% moisture content. Any other materials used for form members shall meet or exceed the above mentioned minimum standard to resist decomposition when in contact with earth or soils and equally impervious to attack by termites and other pests or fungi.

These are a selfcontained footing form and foundation wall system, which unlike conventional forms may be left in the ground after the installation of the selfleveling foundation media, which at the present state of the art is concrete. These forms are superior to conventional forms in that they may be prefabricated either in a factory or in the field, and once staked in place and leveled, comprise a complete economical form for a footing, with minimal waste of footing material or media and the foundation wall. Because the form members do not react when in contact with the earth, form members can be backfilled without their removal. As soon as the selflevelling and selfhardening foundation media is set or cured, the building may be constructed on top of the foundation walls. This system is superior to the allweather wood footing, for example, in that no precise levelling or compacting of a gravel bed is required. Another object of this invention is to more closely monitor and control the use of the foundation materials, both concrete and form materials, by eliminating waste of materials and to reduce all labor costs involved in the removal of forms, which is presently required by all building codes.

Therefore, it is also the objective of the present invention to provide a novel footing form which does not have to be removed from with ground and which is integrated and made a part of the foundation or stem wall, unlike other systems in which footings are formed separately, filled with the footing material, the forms then removed before a foundation or stem wall can be built or installed.

DESCRIPTION OF THE PREFERRED EMBODIMENTS

Figure 1:
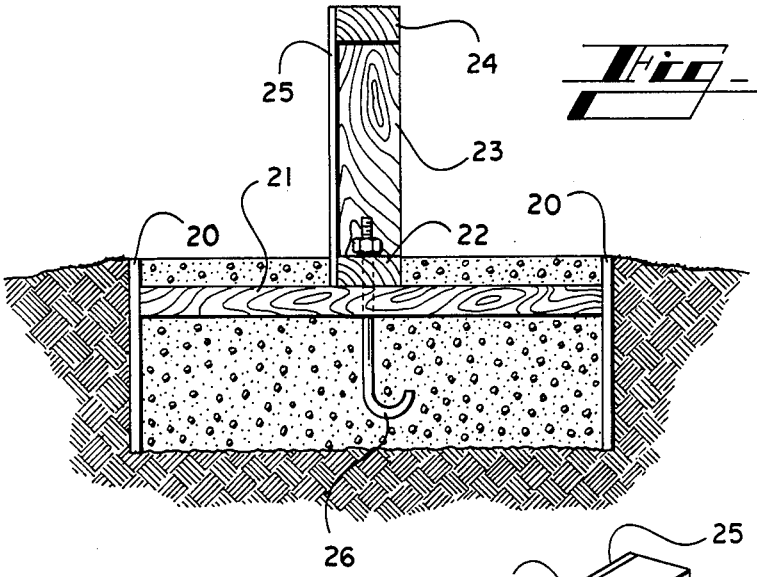
FIG. 1 is an end profile showing a cross sectional view of the concrete footing, the form skirts and the wood stem wall with the earth backfilled against the skirts.
Figure 2:
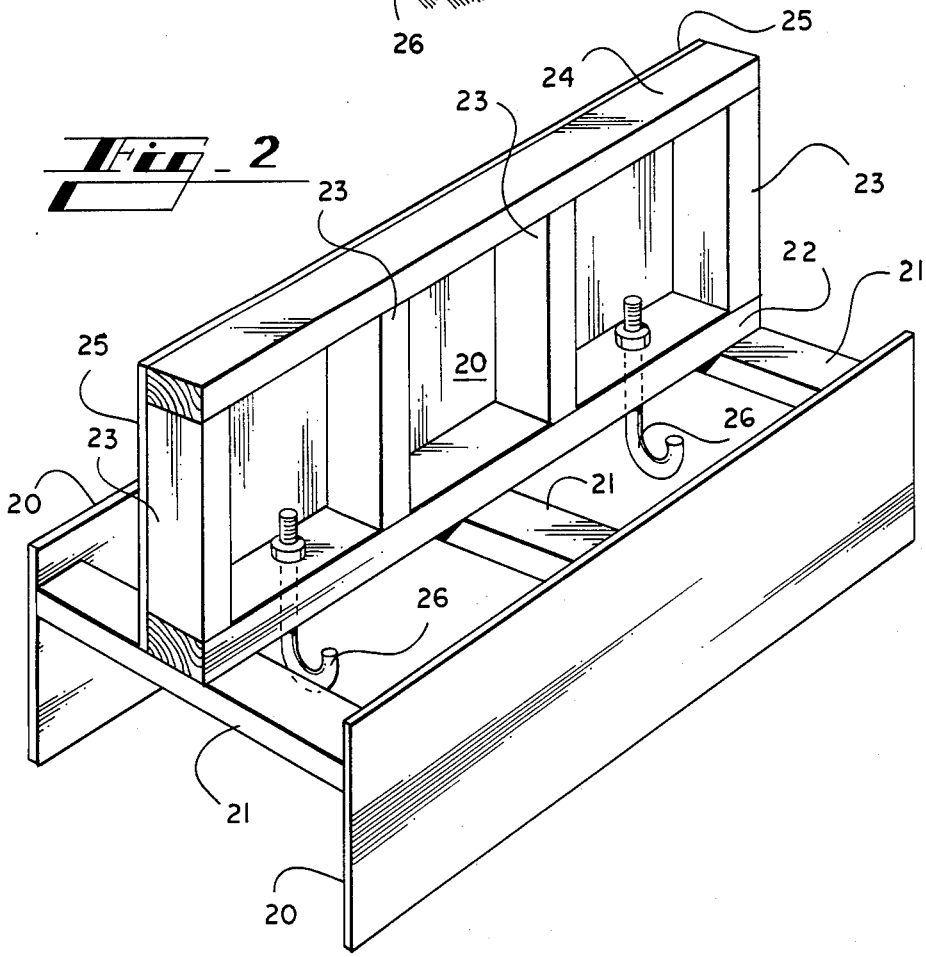
FIG. 2 is a perspective view of a portion of the footing form showing the relationship of the skirts, form spreaders and the stem wall prior to its installation into the foundation trench and prior to the installation of concrete between the skirts and from the ground up to the form spreaders.

The best mode for carrying out the invention is presented in the terms of a preferred and second embodiment. Both embodiments use the same basic configuration, except the preferred embodiment is prefabricated in a factory or plant where more economical and precise procedures may be used. The second embodiment is the field or site fabrication of an identical product. Both embodiments are depicted in FIG. I and II consisting of the form skirts 20, the form spreaders 21, the bottom plate 22, the wall risers 23, the top plate or sill 24, and anchors 26.

A foundation wall of any required height, as allowed by the applicable building code and individual design, is fabricated from a bottom plate (22) of the desired length, a multiplicity of wall risers (23) of the desired height, a top plate or sill (24) being the same length as (22), and a wall face (25). To the bottom plate (22) is attached with code approved fastening devices or fastening or attached systems at intervals as required by code or design, the form separators (21), perpendicular to the bottom plate (22). The form separators (21), should be centered as near as possible with relation to the bottom plate (22). To the extended ends of the form separators (21), is attached the form skirts (20), leaving a portion of the skirts above the top of the separators (21). This extension is not critical and may be of varying distance. Holes of the proper size are drilled in the bottom plate (22) as required by code or design and appropriately sized code approved foundation anchors (26) are inserted to secure the footing to the foundation wall once the selflevelling selfhardening foundation media is installed. A multiplicity of these sections are then utilized to make an isolated or continuous footing and foundation wall. The material used to fabricate the forms and the foundation walls must have characteristics which do not allow the material to deterorate or decompose when in contact with earth or soils, the selfleveling selfcuring foundations materials and are impervious to attack by termites or other pests or fungi which may act upon the material in any destructive manner, which at the present state of the art includes treated lumber or plywood which meets the minimum standards of the American Wood Preservers Bureau Standard "FDN" with 0.60 pounds per cubic foot of retention, after drying to 19% moisture content.

The form members (21), (22), (23), (24) as illustrated in FIG. 1 may be substituted by any dimension for a form ember as may be required for the design of a particular foundation. Dimension for (20), skirts, may vary in length, width and thickness as required by local building departments. After the selflevelling foundation, such as concrete, is installed the forms are leftin place and dirt, soil, or other material is backfilled directly against the forms. Forms may be either factory or field produced in any length as required by a particular footing design. When turning a corner, a suitably sized section of the skirt, (20), is removed so that the footing is continuous and not cut into sections. Reinforcing materials, such as steel reinforcing bars, may be placed in the forms if required.

While the invention has been described in complete detail and pictorially shown in the accompanying drawings, it is not to be limited to such details, since many changes and modifications may be made without departing from the spirit and scope of the invention. Hence it is described to cover any and all modifications and forms which may come within the language and scope of the appended claims.

We claim:

1. A form for use in constructing the foundation of a building which foundation will have a predetermined height and width, said form comprising:

(a) a pair of laterally spaced skirt members being spaced apart by a distance equal to said predetermined width and having a height at least equal to said predetermined height;

(b) at least two spreaders equal in length to said predetermined width and secured at their ends to said skirt members;

(c) a bottom plate secured to said spreaders;

(d) a plurality of wall risers secured to said bottom plate; and (e) a top plate secured to said plurality of wall risers, said skirt members, spreaders, bottom plate, and risers all being fabricated from material which will resist decomposition whereby said form is adapted to be placed into an excavation, filled with concrete, and left in place to become part of a composite foundation for a building.

2. The form of claim 1 wherein anchors are provided on said bottom plate for attaching said bottom plate directly to concrete poured between said skirt members.

3. The form of claim 1 wherein the skirt members, spreaders, bottom plate and risers are formed of treated lumber.

4. The form of claim 1 wherein a face wall is secured to said risers.

* * * * *